US010018016B2

(12) United States Patent
Crawford et al.

(10) Patent No.: US 10,018,016 B2
(45) Date of Patent: Jul. 10, 2018

(54) WIRELINE FLUID BLASTING TOOL AND METHOD

(71) Applicants: James B Crawford, Lafayette, LA (US); Joseph W Elsbury, III, Broussard, LA (US)

(72) Inventors: James B Crawford, Lafayette, LA (US); Joseph W Elsbury, III, Broussard, LA (US)

(73) Assignee: Advanced Wireline Technologies, LLC, Lafayette, LA (US)

( * ) Notice: Subject to any disclaimer, the term of this patent is extended or adjusted under 35 U.S.C. 154(b) by 306 days.

(21) Appl. No.: 14/800,920

(22) Filed: Jul. 16, 2015

(65) Prior Publication Data

US 2016/0017691 A1 Jan. 21, 2016

Related U.S. Application Data

(60) Provisional application No. 62/026,371, filed on Jul. 18, 2014.

(51) Int. Cl.

| | |
|---|---|
| ***E21B 37/00*** | (2006.01) |
| ***E21B 37/06*** | (2006.01) |
| ***E21B 37/02*** | (2006.01) |
| ***E21B 17/10*** | (2006.01) |

(52) U.S. Cl.

CPC ..... *E21B 37/00* (2013.01); *E21B 17/10* (2013.01); *E21B 37/02* (2013.01); *E21B 37/06* (2013.01)

(58) Field of Classification Search

CPC ..... E21B 37/00; E21B 37/02; E21B 37/06

See application file for complete search history.

(56) References Cited

U.S. PATENT DOCUMENTS

| | | | | |
|---|---|---|---|---|
| 3,922,403 | A | 11/1975 | Sample, Jr. et al. | |
| 4,190,113 | A | 2/1980 | Harrison | |
| 4,254,962 | A | 3/1981 | Blackwell | |
| 4,317,407 | A | 3/1982 | Blackwell | |
| 4,793,417 | A | 12/1988 | Rumbaugh | |
| 5,195,585 | A | 3/1993 | Clemens et al. | |
| 5,533,571 | A | 7/1996 | Surjaatmadia et al. | |
| 6,122,791 | A | 9/2000 | Baugh et al. | |
| 6,374,838 | B1 * | 4/2002 | Baugh | B08B 9/053 134/167 C |
| 6,523,615 | B2 | 2/2003 | Gandy et al. | |

(Continued)

OTHER PUBLICATIONS

Wire Rope Pig, Crawford Technical Services, Inc.

*Primary Examiner* — Robert E Fuller

(57) ABSTRACT

A wireline deployed fluid blasting tool for removing obstructions from oil and gas wellbore tubing is disclosed. The tool has an inner tubular mandrel retaining a releasable outer sleeve creating an annular fluid passage in communication with fluid ejection ports. Resilient seals seal the annulus between the tool and the wellbore tubing allowing fluid pressure above the tool to advance the tool through the tubing. Fluid enters the annular fluid passage through fluid perforations in the outer sleeve to exit the fluid ejection ports to create a fluid blast to remove obstructions. The outer sleeve shifts along the inner mandrel by fluid pressure to open fluid inlet passages into the inner mandrel allowing fluid to enter and exit through the mandrel while bypassing the annular fluid passage and fluid ejection ports to facilitate pulling the tool from the tubing.

26 Claims, 14 Drawing Sheets

(56) References Cited

U.S. PATENT DOCUMENTS

| | | | | |
|---|---|---|---|---|
| 6,651,744 | B1 | 11/2003 | Crawford | |
| 6,758,279 | B2 | 7/2004 | Moore et al. | |
| 6,840,315 | B2 | 1/2005 | Jarchau et al. | |
| 7,011,158 | B2 | 3/2006 | Davis et al. | |
| 7,178,588 | B2 | 2/2007 | Harper et al. | |
| 7,279,052 | B2 | 10/2007 | Kinnari et al. | |
| 7,406,738 | B2 | 8/2008 | Kinnari et al. | |
| 7,617,873 | B2 | 11/2009 | Lovell et al. | |
| 7,624,806 | B2 * | 12/2009 | Booth | B08B 9/055 15/104.061 |
| 7,987,906 | B1 | 8/2011 | Troy | |
| 8,312,930 | B1 | 11/2012 | Glass | |
| 8,356,377 | B2 | 1/2013 | Harper | |
| 2001/0043838 | A1 | 11/2001 | Baugh et al. | |
| 2003/0019665 | A1 | 1/2003 | Horton | |
| 2004/0112588 | A1 * | 6/2004 | Mullins | E21B 21/103 166/177.3 |

* cited by examiner

WIRELINE FLUID BLASTING TOOL AND METHOD

PRIORITY

This application claims priority to U.S. provisional application Ser. No. 62/026,371 filed Jul. 18, 2014 entitled "Wireline Fluid Blasting Tool and Method", the entire content of which is incorporated by reference.

FIELD OF THE INVENTION

This invention relates to a method and apparatus for the removal of obstructions, deposits, and debris from wellbore production tubing and other confined areas. More particularly, the invention discloses a wash tool deployed by wireline to remove obstructions from production tubing such as obstructions from paraffin, scale, and other debris that reduce or prevent well flow.

BACKGROUND

A problem frequently encountered during the production of oil and gas is the accumulation of paraffin wax, scale, and debris in the interior or bore of the well production tubing. This wax and debris builds up over time to create restrictions or blockages in the production tubing bore that correspondingly reduce the tubing flow area and the rate of hydrocarbon flow from the well. Often the accumulated wax and debris will completely block the production tubing bore to cease hydrocarbon flow and well production altogether.

A scratching tool attached to the wireline of a wireline unit is often used to remove accumulated wax and other obstructions from production tubing. When a wireline unit is used on an offshore well, the wireline unit must be deployed to the offshore well location by boat, lifted on the platform, and installed for use. When the wireline unit is finally in place at the well location and rigged up for use, it often takes several days of operation with the wireline and scrapping tool before the production tubing is sufficiently cleared of obstructions to allow production to be resumed.

If the blockage or obstruction in the production tubing is so severe that it cannot be cleared by the wireline scraping tool then other options must be considered. These options typically require cleaning tools deployed by a coiled tubing service package or by a hydraulic workover rig. Deploying a coiled tubing service package or a hydraulic workover rig to an offshore location will dramatically increase the cost of servicing the well to increase production. If the well to be serviced is only marginally producing hydrocarbons, the anticipated revenue to be generated from the well production may not justify the cost of these additional tubing cleanout operations and such a well will likely be plugged and abandoned.

Because of the high costs typically associated with servicing a well to remove accumulated obstructions, there is a need for a more efficient and cost effective wireline deployable tool and method for removing restrictions and obstructions from the production tubing of oil and gas wells.

SUMMARY OF THE INVENTION

A fluid blasting tool and method in combination with a heavy wireline unit, heated fluids, and chemicals is disclosed for removing paraffin and scale from the bore of production tubing of oil and gas wells. This tool and method allows certain internal pipe deposits and obstructions to be removed and the inside pipe wall of wellbore tubing to be cleaned of paraffin and scale without brushes or scraping devices.

The fluid blasting tool is tethered to a wireline and run through the production tubing for clearing obstructions. The wireline allows the fluid blasting tool to be deployed at the location in the tubing bore where the obstruction is occurring. The fluid blasting tool provides a jetted stream of heated fluids and chemical additives to dissolve the obstruction caused by accumulated paraffin wax and debris.

The fluid blasting tool is provided with top and bottom resilient elastomer sealing cups. These resilient cups seal the interior of the tubing bore, i.e. the annular opening between the fluid blasting tool and the interior of the tubing bore. The resilient sealing cups allow fluid pressure to be generated in the tubing bore behind the fluid blasting tool. This fluid pressure then pushes the fluid blasting tool at the end of the wireline through tubing bore towards the obstruction. The resilient cups allow the fluid blasting tool to be advanced through the tubing bore even when the diameter of the tubing bore changes along the length of the tubing bore.

The resilient sealing cups allow the tool to be inserted and removed by wireline through production tubing even tubing having geometry restrictions caused by factors such as S type nipples, X type nipples, gas lift mandrels, and differences in the size of production tubing. In one embodiment each of the resilient cups is tapered at both ends to create an elongated football-shaped cup. The tapered ends of the football-shaped resilient cups allow the tool to be more readily pushed through a tubing bore by fluid pressure and pulled from a tubing bore by the wireline even when the dimension or geometry of the tubing bore is restricted by bends, turns, nipples, mandrels, tubing changes, or the like.

The fluid blasting tool has a plurality of radial fluid passages in fluid communication with ejection ports positioned at the nose of the tool. When the fluid blasting tool is positioned in the production tubing at a desired location, the pressurized fluid created in the tubing bore behind the fluid blasting tool moves the fluid through the fluid passages of the blasting tool and out of the ejection ports at the nose of the tool. The radial fluid passages in the fluid blasting tool provide a vehicle for delivering a dynamic blast or stream of pressurized fluids from the fluid ejection ports of the blasting tool to the paraffin and scale obstruction in the production tubing.

Preferably the fluids streamed or jetted through the ejection ports of the fluid blasting tool will be heated fluids and chemicals that will enhance dissolution of the accumulated paraffin and break up the obstruction. The heated fluids and chemicals may include hot water, hot oil, steam, surfactants including dispersants, soaps, cleaners, and degreasers, asphaltene solvents, xylene, and diesel among many others.

A scrapper may be mounted with the fluid blasting tool to enhance the effectiveness provided by the fluid blasting tool.

DESCRIPTION OF THE INVENTION

Figure 1:
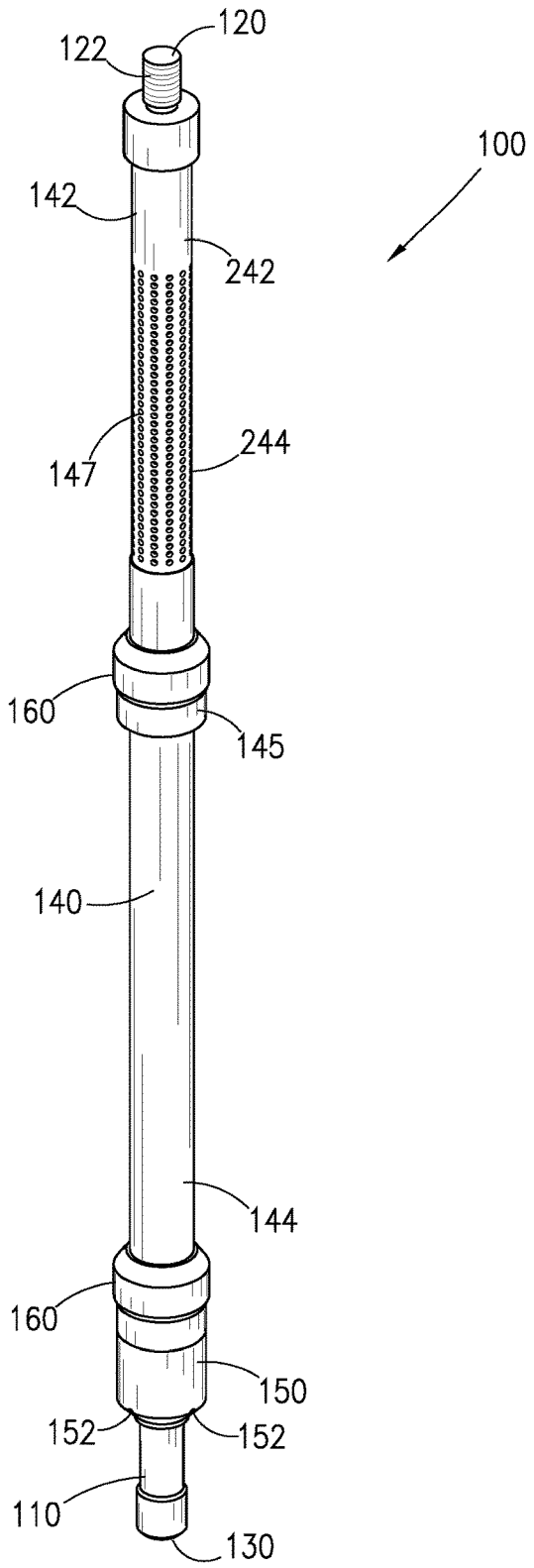
FIG. 1 is a perspective view of the fluid blasting tool of Applicants' invention.

FIG. 1 is a perspective view of one embodiment of the fluid blasting tool (100) of Applicants' invention is comprised of an inner tubular mandrel (110) and an outer tubular sleeve (140) slidably positionable on the inner tubular mandrel (110). Tubular mandrel (110) has an upper trailing wireline connection (120) and a lower leading fluid bypass outlet (130). The wireline connection (120) of the tubular mandrel is configured with attachment threads (122) or other means for connecting the blasting tool (100) to the end of a wireline cable on a wireline unit.

Figure 2A:
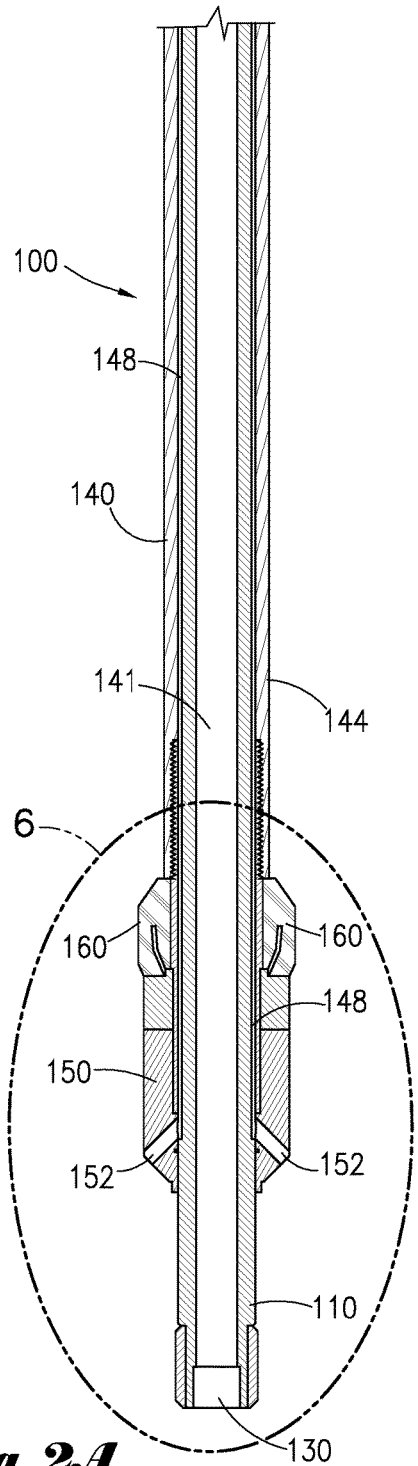
FIGS. 2A and 2B a longitudinal cross-section view of the fluid blasting tool of FIG. 1 with the outer sleeve and nose cone in a closed position.
Figure 2B:
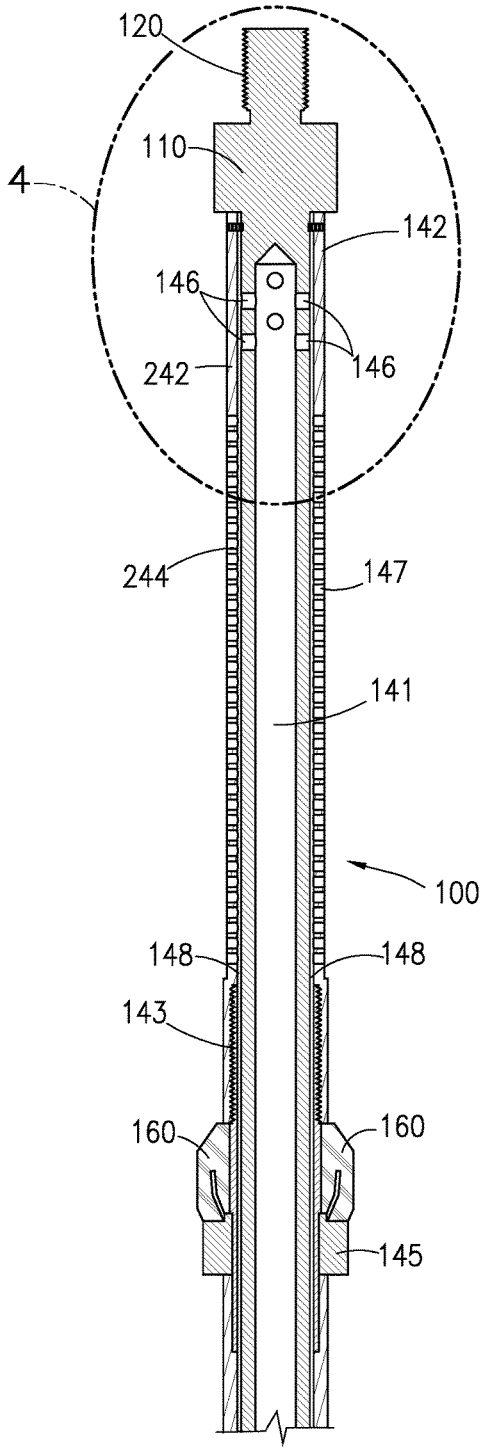

As shown in FIGS. 2A and 2B, inner tubular mandrel (110) has a central fluid passage (141) that runs longitudinally through tubular mandrel (110). The central fluid passage (141) is in fluid communication with the fluid bypass outlet (130), and a plurality of radially oriented angled fluid entry ports (146) at its upper end. The slidably positionable tubular outer sleeve (140) has an upper end that is releasably attached to the upper end of inner tubular mandrel (110) in an upward, closed position, by a plurality of shear pins or shear screws (112). The tubular outer sleeve (140) is positioned around the tubular mandrel (130) to create an annular fluid passage (148) in the annular space between inner tubular mandrel (110) and tubular outer sleeve (140). The lower end of the tubular outer sleeve (140) has a nose cone (150) with a plurality of radially oriented fluid ejection ports (152) in fluid communication with annular fluid passage (148).

Resilient radial tubular seals (160) fitted around the outer sleeve (140) are provided to seal the annulus between the outer sleeve (140) of the fluid blasting tool (100) and the inner wall of production tubing where fluid blasting tool (100) will be utilized. The resilient tubular outer sleeve (140) may have radially extending shoulders (145) to support the resilient tubular seals (160) and guard against dislodgement of the seals (160) from outer sleeve (140).

Figure 8:
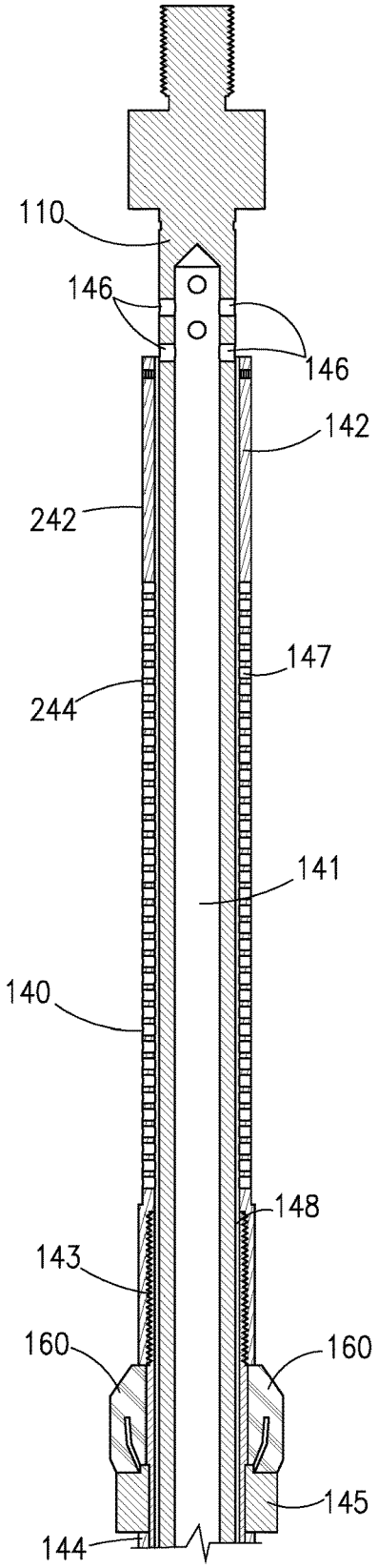
FIG. 8 is a partial longitudinal cross-section view of the upper connection end of the fluid blasting tool of FIG. 1.

As shown in FIG. 8, the tubular outer sleeve (140) has a first or upper attachment section (142) threadably attached at threaded connection (143) to a second or lower nose cone section (144) that supports the nose cone (150). The upper attachment segment (142) has an upper solid section (242) and a perforated lower section (244). The perforated lower section (244) has a plurality of fluid perforations (147) that provide fluid passages for fluid into the annular fluid passage (148). The fluid passages may be screened to prevent debris from entering the annular fluid passage (148) and the fluid ejection ports (152).

Figure 4:
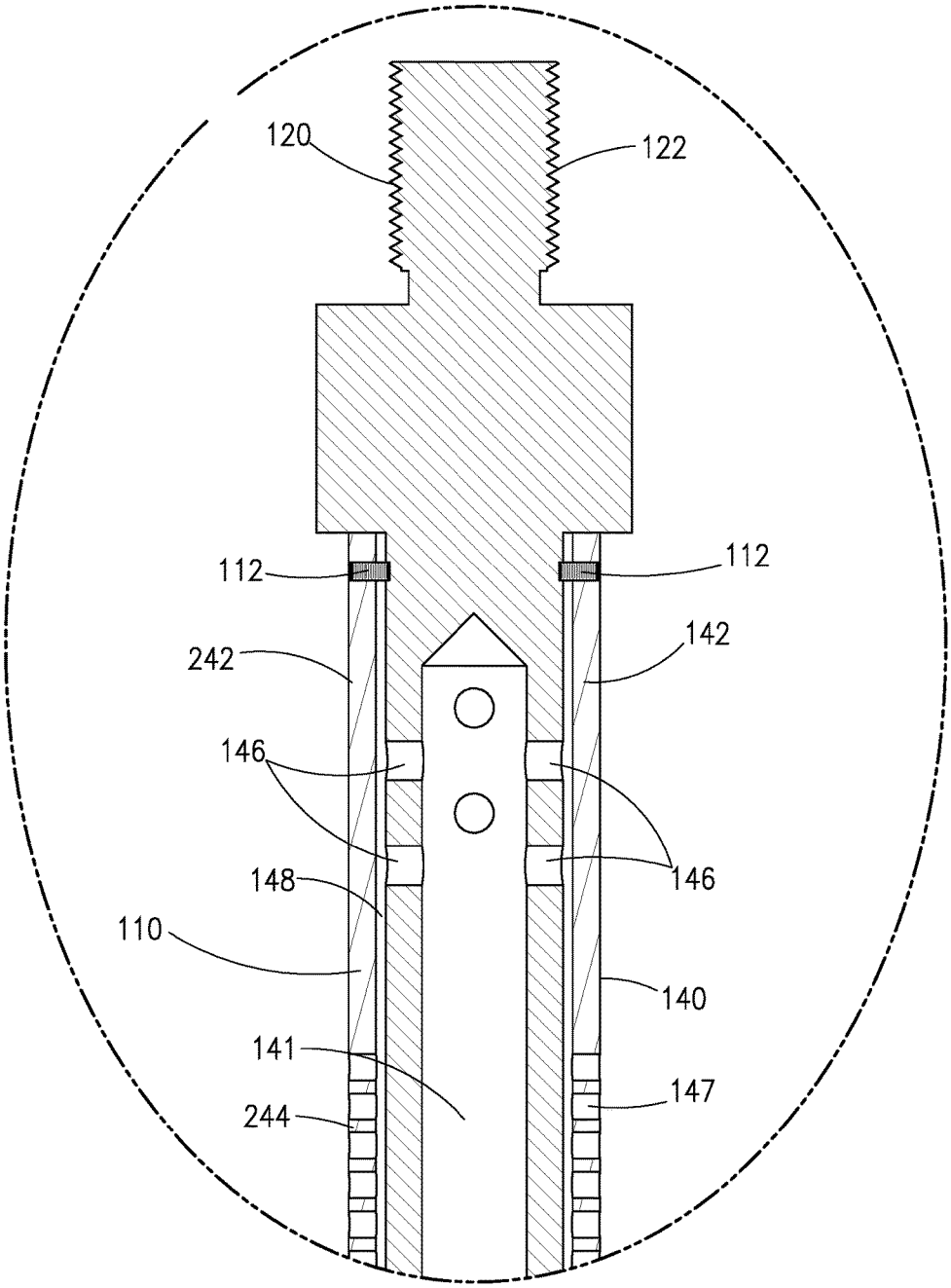
FIG. 4 is longitudinal cross-section view of the upper connection end of the fluid blasting tool of FIG. 1 with the outer sleeve and nose cone in the closed position shown in FIGS. 2A and 2B.
Figure 6:
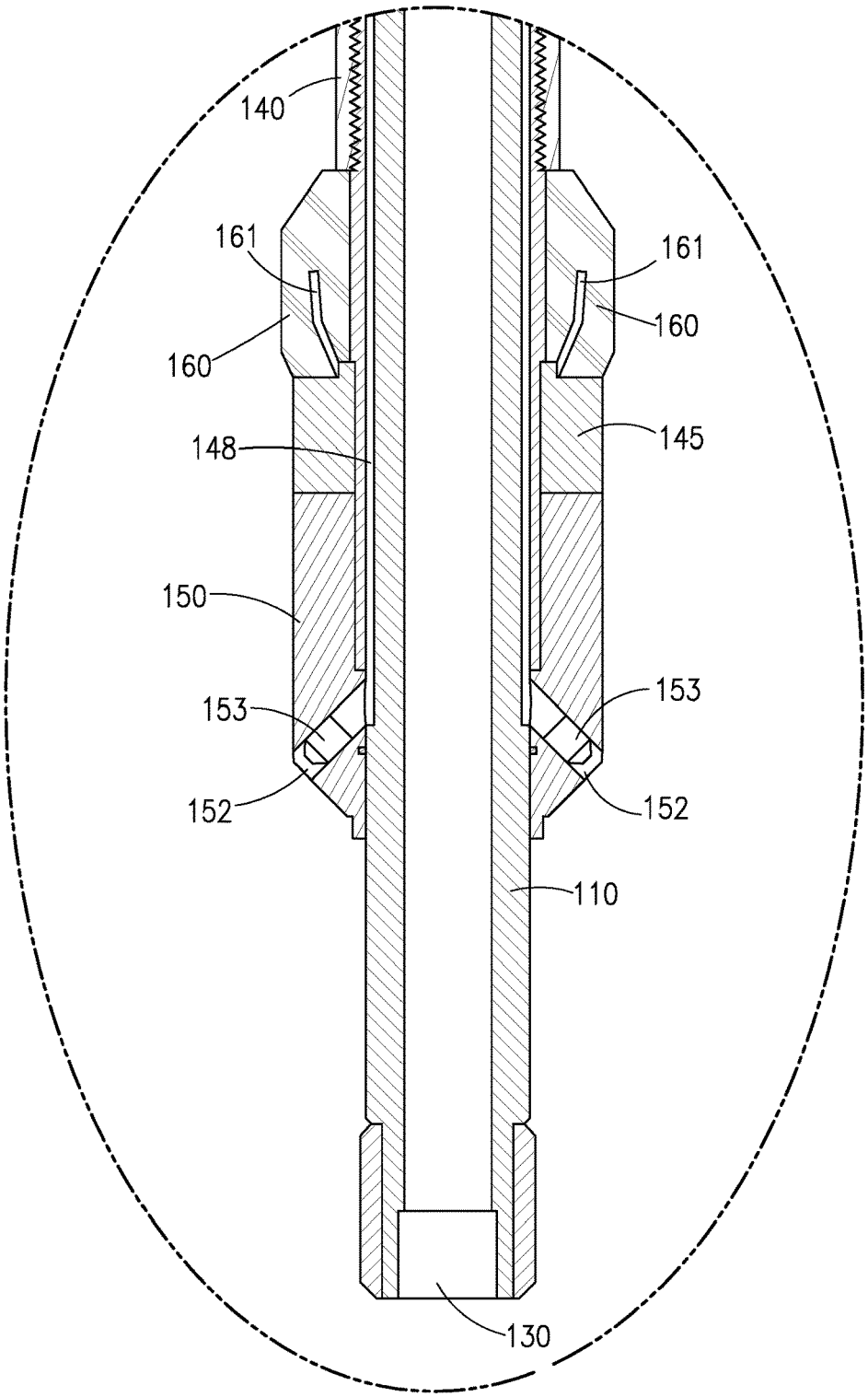
FIG. 6 is longitudinal cross-section view of the lower nose cone end of the fluid blasting tool of FIG. 1 with the outer sleeve and nose cone in the closed position shown in FIGS. 2A and 2B.

As shown in FIGS. 4 and 6, when the tubular outer sleeve (140) is releasably held in the upward closed position with shear screws (112), the radially oriented fluid entry ports (146) of the inner tubular mandrel (110) are adjacent to the tubular outer sleeve (140). When the tubular outer sleeve (140) is so positioned, fluid entry ports (146) at the upper end of the tubular mandrel (110) are blocked by tubular sleeve (140) to restrict fluid passage through the central fluid passage (141) of the inner tubular mandrel (110). With fluid entry ports (146) blocked by tubular sleeve (140), fluid in the production tubing behind the tool (100) will flow through fluid perforations (147) into annular fluid passage (148) for ejection through the fluid ejection ports (152) of the nose cone (150). Nozzles or jets (153) may be provided in fluid ejection ports (152) to direct and concentrate the fluid blast.

Figure 3A:
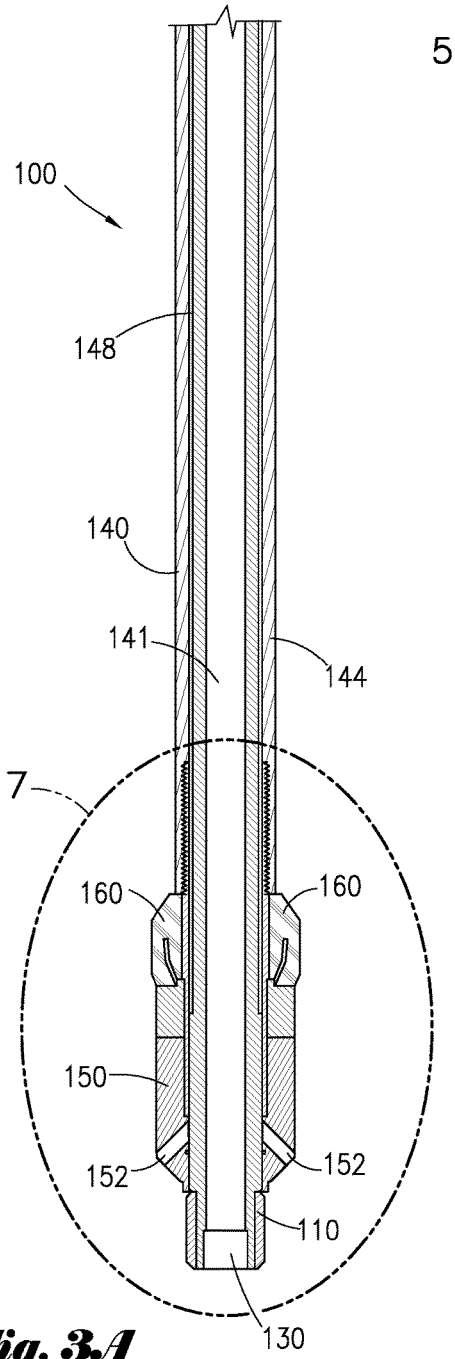
FIGS. 3A and 3B show a longitudinal cross-section view of the fluid blasting tool of FIG. 1 with the outer sleeve and nose cone shifted forward to an open position.
Figure 3B:
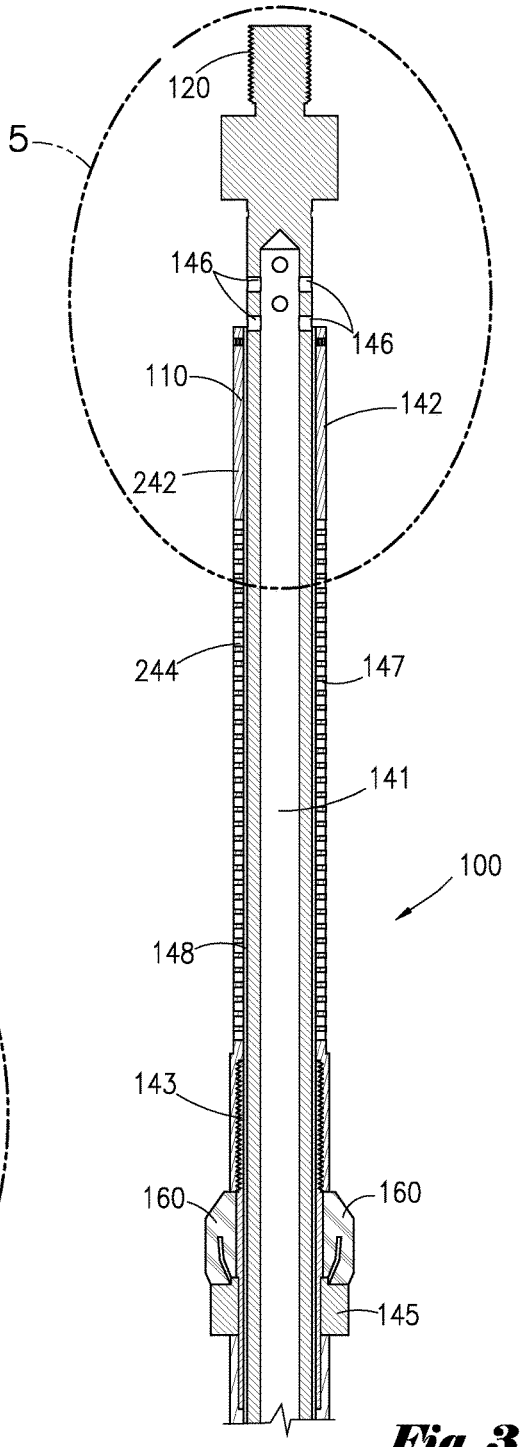

FIGS. 3A and 3B show the slidably positionable tubular outer sleeve (140) in an open downward position shifted toward the lower nose cone end of the tubular mandrel (110). The outer sleeve (140) shifts to the open position when fluid pressure in the tubing behind the blasting tool (100) is increased sufficiently to sever or shear the shear screws (112) to slide the tubular sleeve (140) along the tubular mandrel (110) toward the fluid bypass outlet (130). The shear screws (112) are selected to separate at a predetermined desired fluid pressure to allow the outer sleeve (140) to shift forward or downward on the tubular mandrel (110) which is restrained by the wireline cable. The outer sleeve (140) may also be releasably connected to the tubular mandrel (110) by a collet assembly or other suitable connection mechanism.

Figure 5:
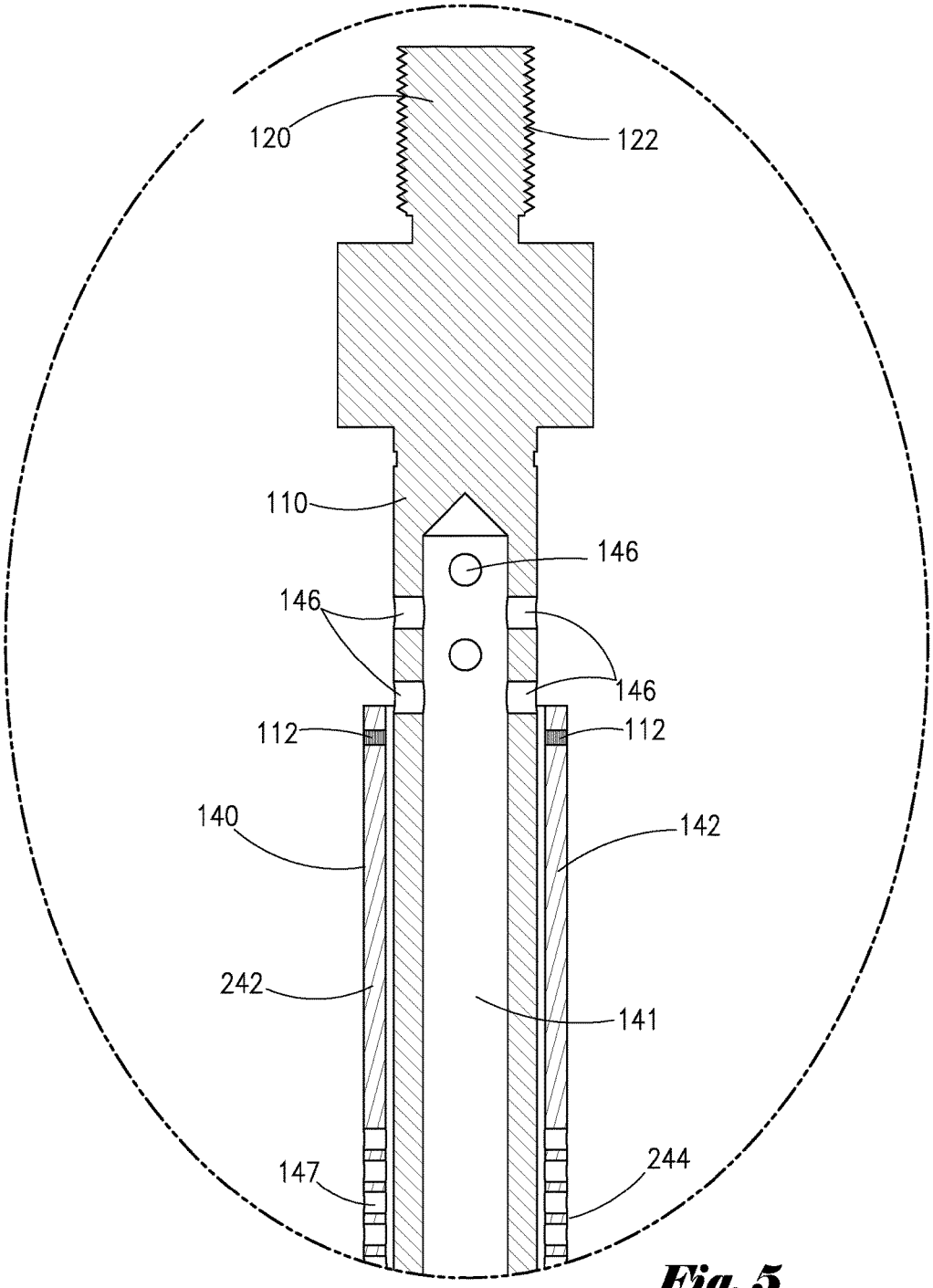
FIG. 5 is longitudinal cross-section view of the upper connection end of the fluid blasting tool of FIG. 1 with the outer sleeve shifted forward to the open position shown in FIGS. 3A and 3B.
Figure 7:
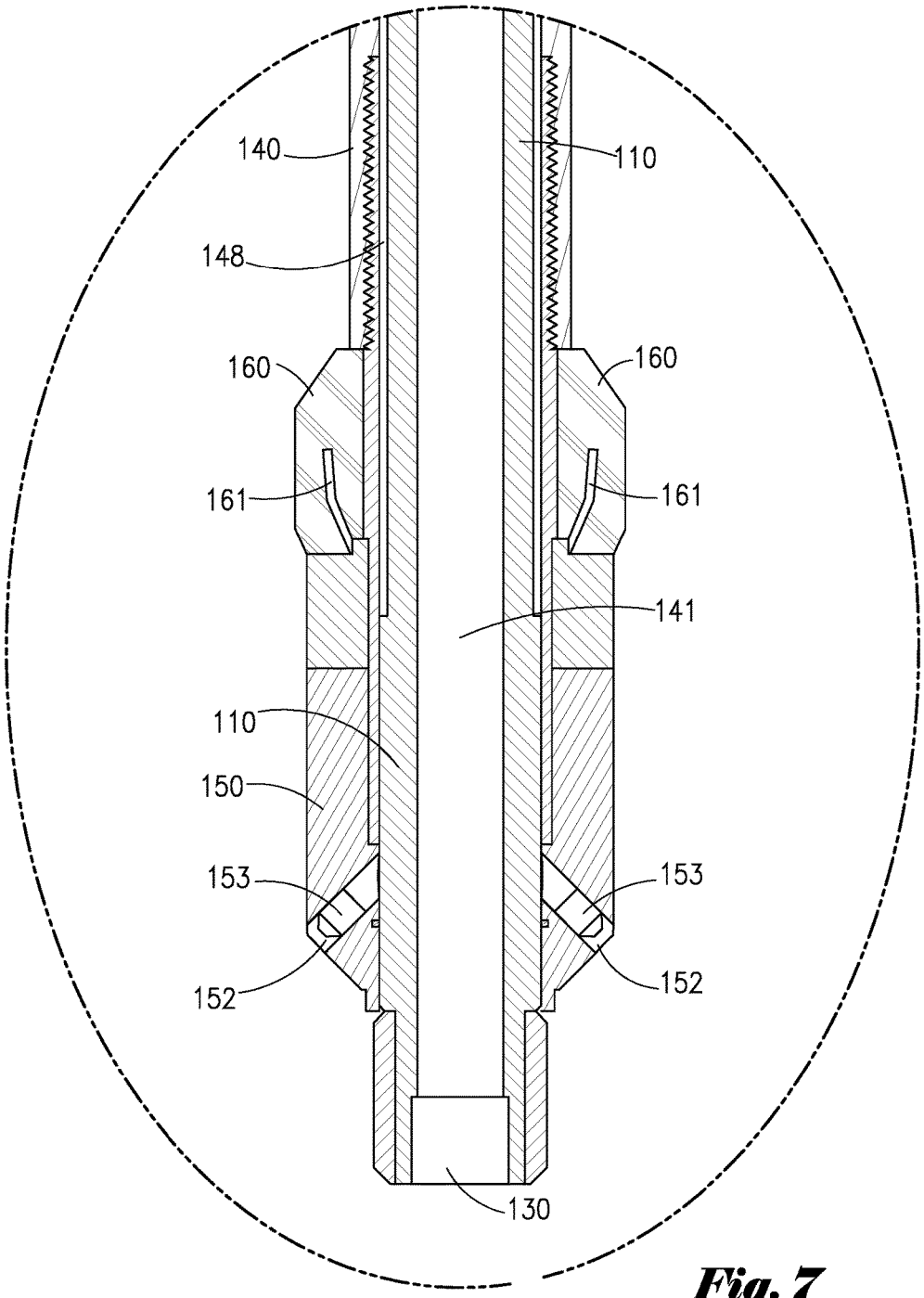
FIG. 7 is longitudinal cross-section view of the lower nose cone end of the fluid blasting tool of FIG. 1 with the outer sleeve and nose cone shifted forward to the open position shown in FIGS. 3A and 3B.

As shown in FIGS. 5 and 7, when shear screws (112) are severed in response to tubing fluid pressure, the tubular outer sleeve (140) slide forward or downward to unblock or open the radially oriented fluid entry ports (146) of the inner tubular mandrel (110). With the outer sleeve (140) fully forward, fluid in the production tubing behind the tool (100) will flow through fluid entry ports (146), into the central fluid passage (141) of the inner tubular mandrel (110), and exit fluid bypass outlet (130) to bypass the annular fluid passage (148) and the fluid ejection ports (152) of the nose cone (150). This will allow removal of the fluid blasting tool (100) from the wellbore tubing and minimize the risk of creating a swabbing pressure in the tubing.

The resilient seal (160) seals the annulus between the blasting tool (100) and the tubing interior tubing wall to allow the fluid pressure above the tool to be maintained for advancing the tool (100) in the wellbore tubing and for creating fluid pressure in the annular fluid passage (148). The seals (160) may be made of polyurethane or other resilient polymer material or polymer combinations. The seals (160) may also be reinforced by metal or other reinforcing material to increase resistance to wear and tear and may be provided with tapered ends to facilitate pushing and pulling the fluid blasting tool (100) through the wellbore tubing during tool insertion and removal. Preferably the seals (160) are threadedly attached to the outer sleeve (140) but attachment screws may also be utilized.

While the slidably positionable tubular outer sleeve (140) is shown in the drawings as having first and second sections (142) and (144), the outer sleeve (140) may be a single tubular section or it may be comprised of any number of threadedly or otherwise connected tubular sections. Similarly, while the tubular mandrel (110) is shown as a single tubular member, the tubular mandrel (110) may be comprised of any number of threadedly or otherwise connected tubular sections.

Figure 11:
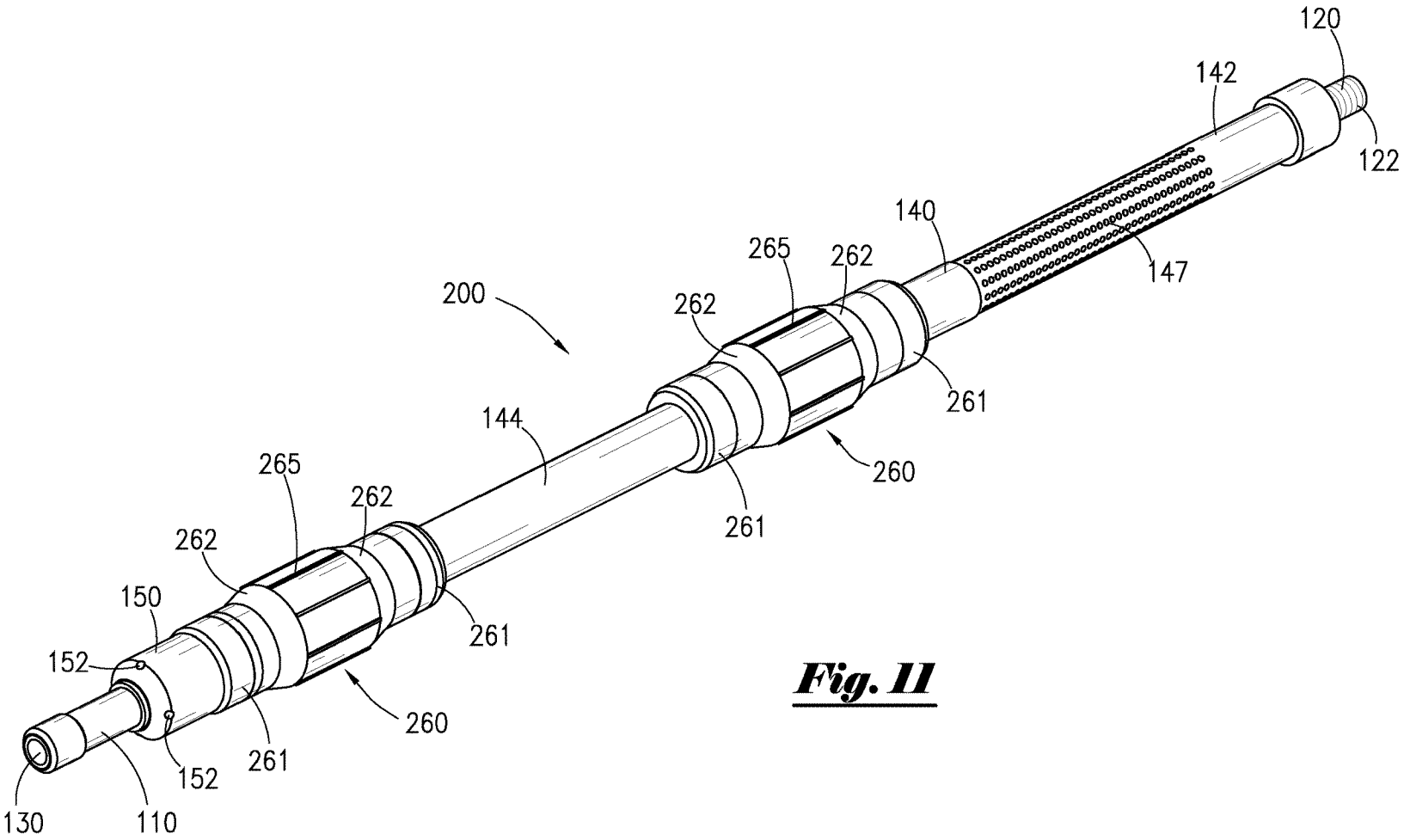
FIG. 11 is a perspective view of an alternate embodiment of the fluid blasting tool shown in FIG. 1 showing the outer sleeve and nose cone in the closed position and having elongated resilient cups with tapered ends.
Figure 12:
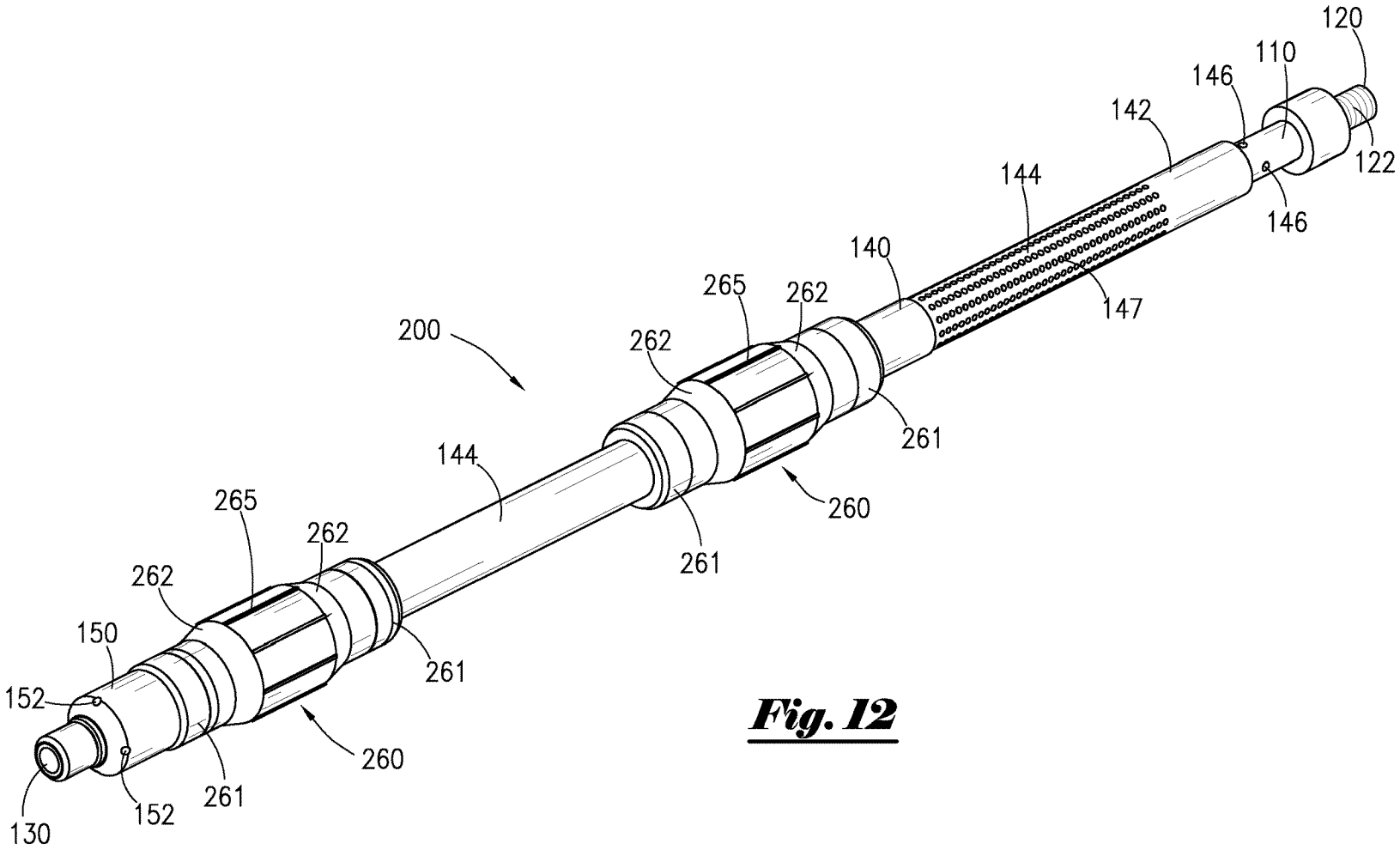
FIG. 12 is a perspective view of the alternate embodiment of the fluid blasting tool shown in FIG. 11 with the outer sleeve and nose cone shifted forward to the open position.

FIGS. 11 and 12 show an alternate embodiment (200) of the fluid blasting tool. Fluid blasting tool (200) has a tubular mandrel (110) with an upper wireline connection (120) and a lower leading fluid bypass outlet (130). The wireline connection (120) is configured with attachment threads (122) for connecting the blasting tool (200) to the end of a wireline cable (WL). As in fluid blasting tool (100), embodiment (200) of the fluid blasting tool has inner tubular mandrel (110) with a central fluid passage (141) that runs longitudinally through tubular mandrel (110). Central fluid passage (141) is in fluid communication with a plurality of radially oriented fluid entry ports (146) at its upper end and a fluid bypass outlet (130) at its lower end. Slidably positionable tubular outer sleeve (140) is releasably attached at the upper end of inner tubular mandrel (110) in an upward, closed position, by a plurality of shear pins or shear screws (112). Outer sleeve (140) has an upper end with a plurality of fluid perforations (147) and a lower end comprised of a nose cone (150) with a plurality of radially oriented fluid ejection ports (152). Inner tubular mandrel (110) and outer sleeve (140) create annular fluid passage (148) in fluid communication with the radially oriented fluid ejection ports (152) of nose cone (150). One or more elongated, football-shaped, resilient radial tubular seals (160) are fitted around the outer sleeve (140). The seals (260) are used to seal the annulus between the outer sleeve (140) of the fluid blasting tool (200) and the inner wall of production tubing where fluid blasting tool (200) will be used as described above for embodiment (100). Radially extending shoulders (145) support resilient tubular seals (260) and guard against their dislodgement from outer sleeve (140).

Figure 13:
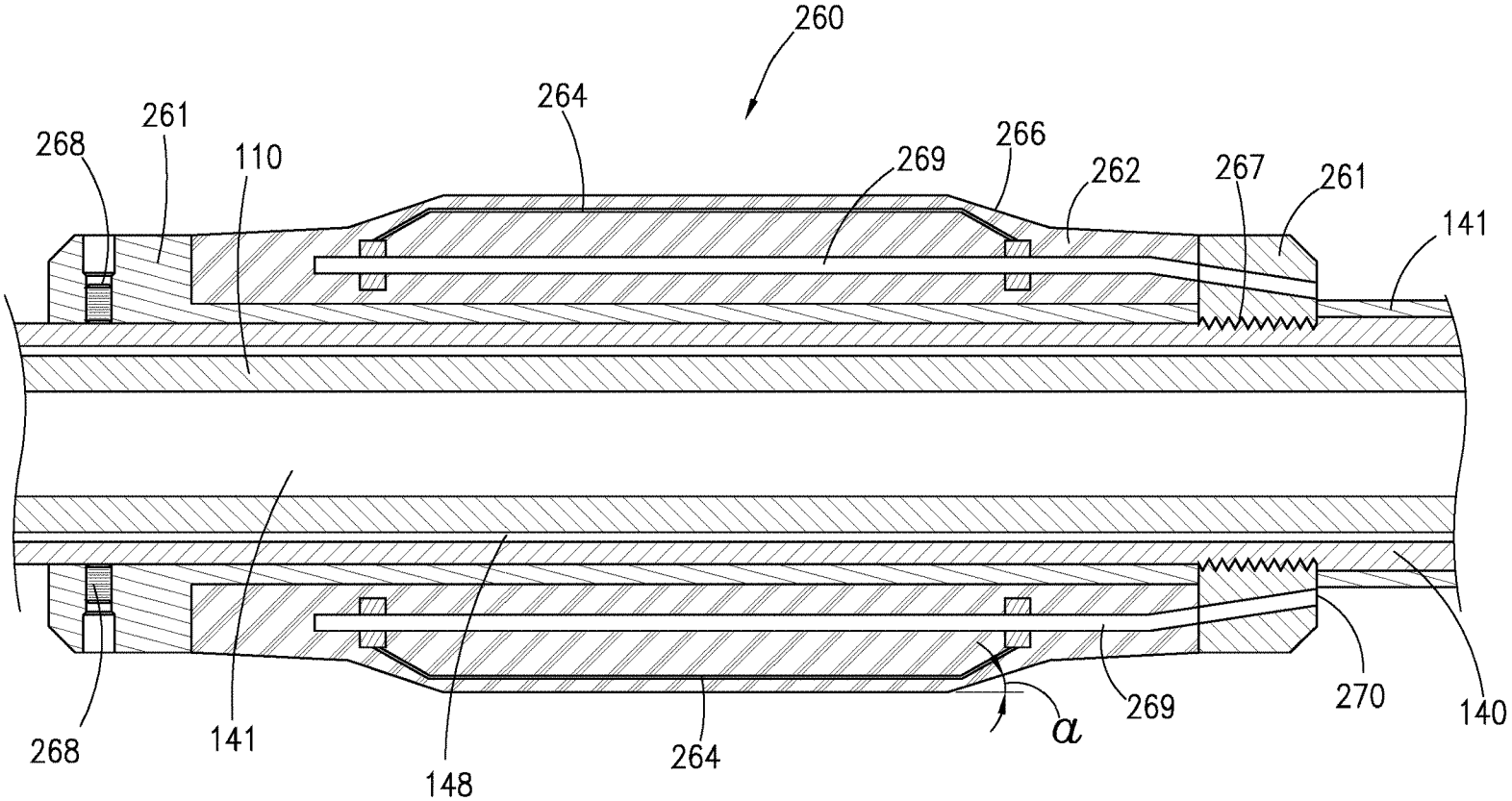
FIG. 13 is a schematic longitudinal cross-section view of the elongated resilient cups shown in FIGS. 11 and 12.

FIG. 13 is a schematic cross-section view of the elongated resilient tubular seal (260) shown in FIGS. 11 and 12. Seal (260) has a tubular base (261) that fits around tubular sleeve (140). The base (261) of seal (260) may be fixed to sleeve (140) by attachment threads (267) or by a plurality of set screws (268), or otherwise suitable attachment mechanisms such as threaded lock nuts placed on the sleeve (140) at each end of the base (261). Affixed to the base (261) is a reinforcement cage (264). An elongated tubular polymer coating (266) having an elongated tapered outer surface (262) is molded around the tubular base (261) and reinforcement cage (264). The tapered outer surface (262) of polymer coating (266) will facilitate the advancement of the tool (200) and attached seal (260) through the production tubing. Preferably the tapered outer surfaces (262) of seal (260) will have an angle ($\alpha$) of no more than 30 degrees below the horizontal.

The polymer coating (266) is comprised of a resilient polymer or combination of polymers such as those described for seals (160) and are selected to resist deterioration by the fluids (F) when the tool (200) is placed in the production tubing (PT) during use. The reinforcement cage (264) may be made of a suitable reinforcing material such as stainless steel configured in a desired pattern and attached to the base (261) to secure the polymer coating (266) and increase resistance to wear and tear. Cage (264) will flex to allow seal (260) to compress and expand as it moves through the wellbore tubing.

Figure 14:
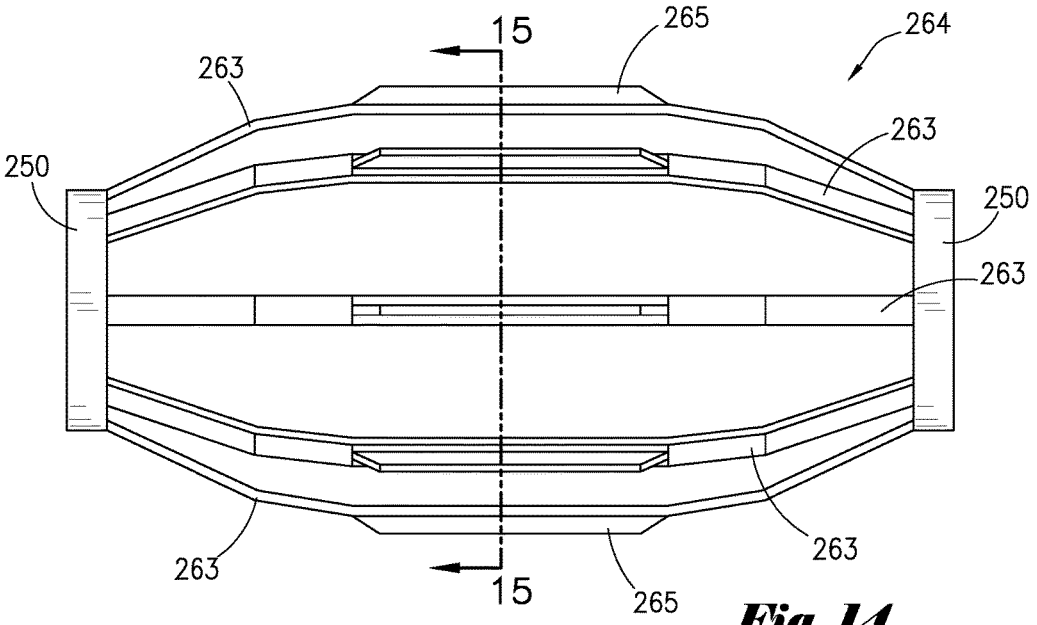
FIG. 14 is a schematic side view of a reinforcing cage for the elongated resilient cups shown in FIG. 13.
Figure 15:
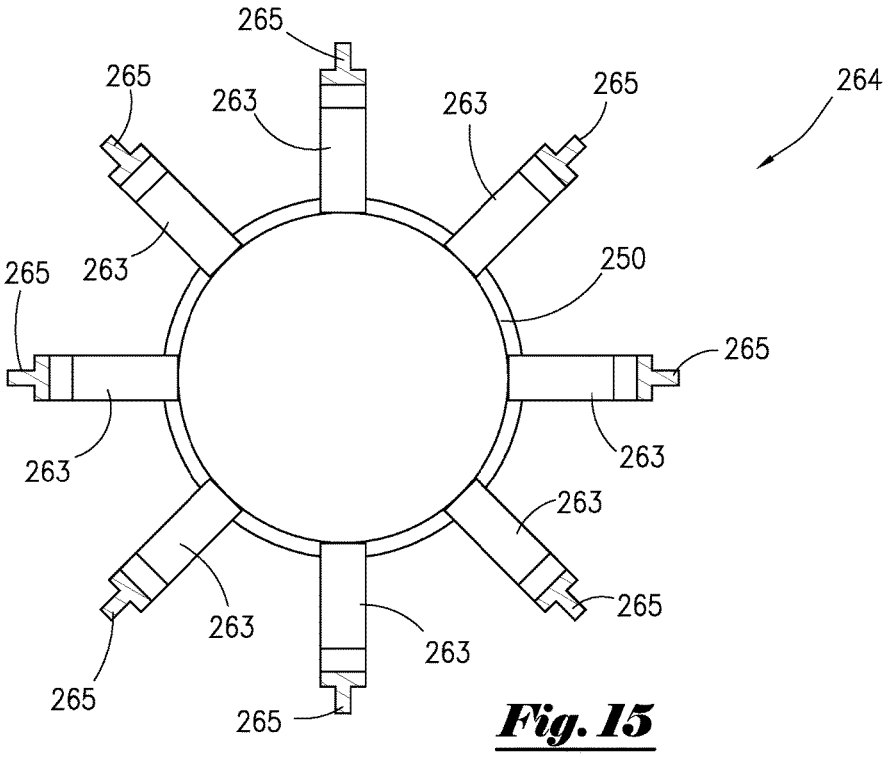
FIG. 15 is a schematic cross-section view of the reinforcing cage shown in FIG. 14.

As shown in FIG. 14, cage (264) of the seals (260) may be comprised of a ringed base (250) having a plurality of radially oriented compressible ribs (263) each having a radially extending fin (265). The fins (265) will serve as a bumper to protect the polymer coating (266) from undue abrasion and enhance the compression of the ribs (263) and the polymer coating (266) as the tool (200) and attached seals (260) and move along the wellbore tubing. The seals (260) may also be provided with an internal chamber (269) in communication with fluid ports (270) in outer surface of base (261). Fluid ports (270) will allow pressurized wellbore fluid to enter the internal chamber (269) of seal (260) to assist in expansion of the seal (260) against the inner wall of the production tubing when the tool (200) is in use.

Operation

Figure 9A:
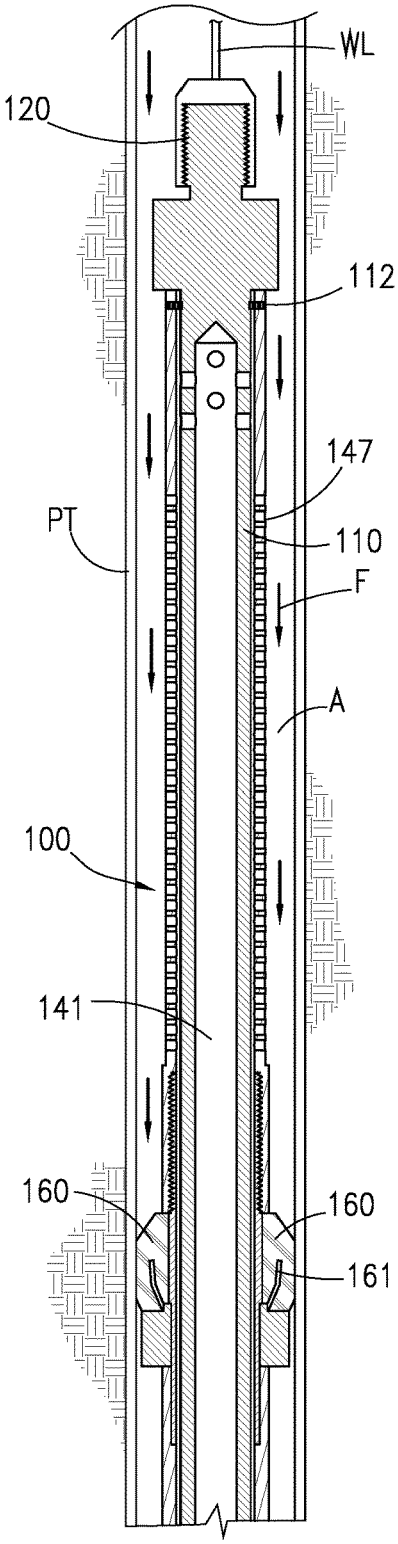
FIGS. 9A and 9B show a longitudinal cross-section view of the fluid blasting tool of FIG. 1 with the tool attached to a wireline and positioned in production tubing of an oil and gas well for removing tubing obstructions.
Figure 9B:
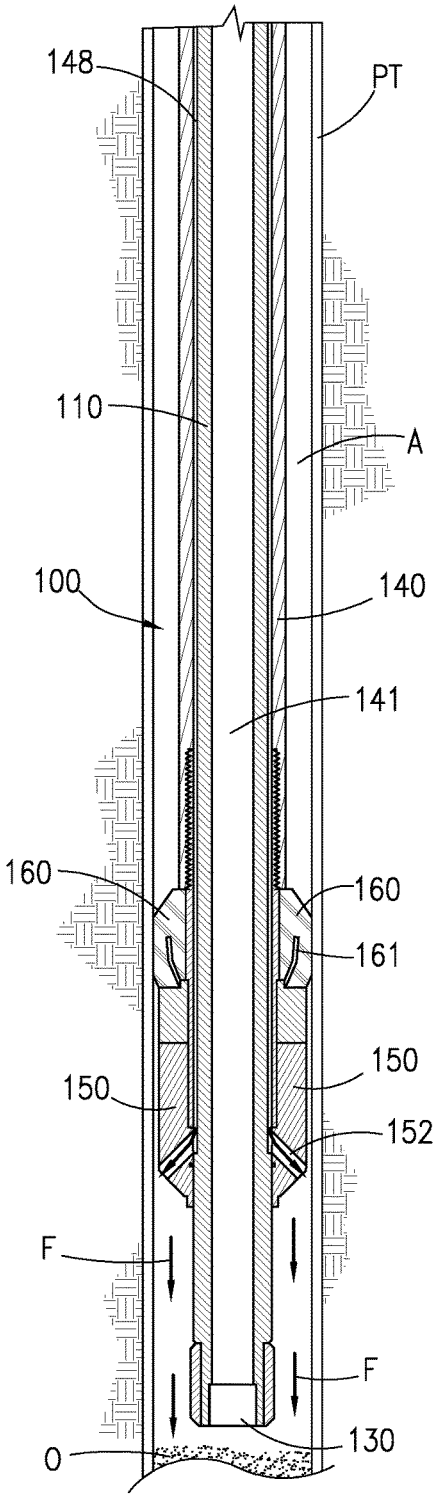
Figure 10A:
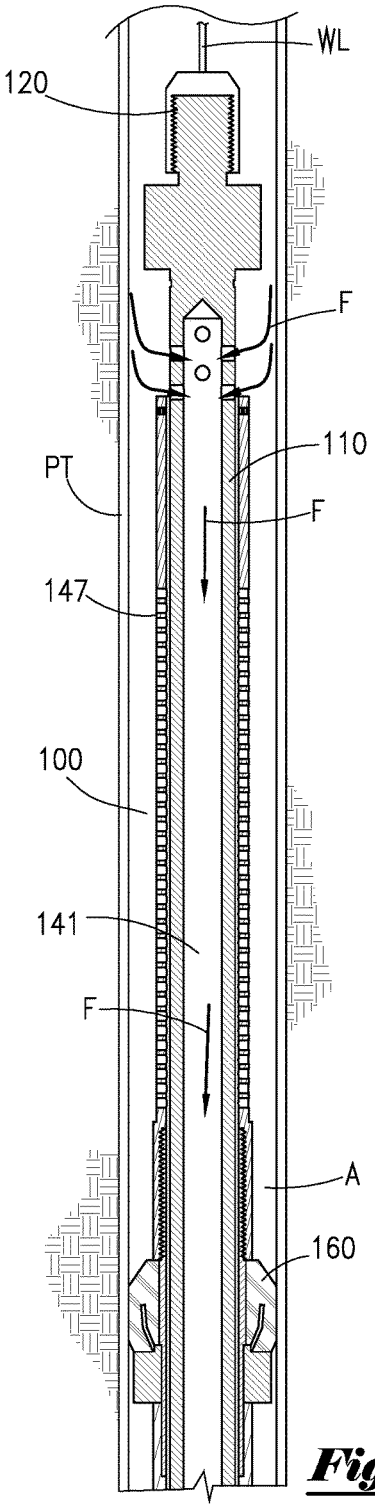
FIGS. 10A and 10B show a longitudinal cross-section view of the fluid blasting tool of FIG. 1 with the tool attached to a wireline and positioned to facilitate removal of the fluid blasting tool from production tubing of an oil and gas well.
Figure 10B:
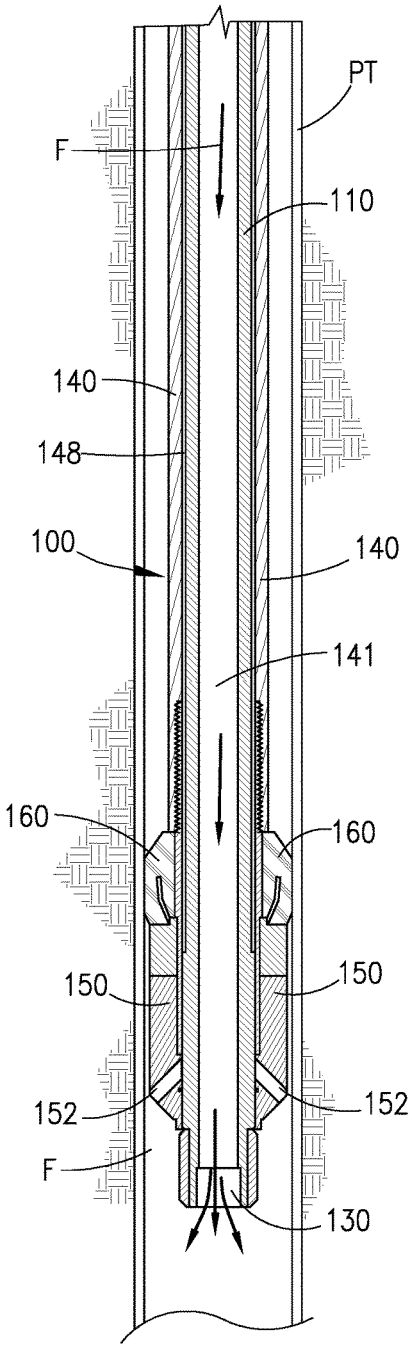

FIGS. 9A and 9B show a longitudinal cross-section view of the fluid blasting tool (100) deployed on a wireline (WL) for clearing an obstruction (O) in production tubing (PT) of an oil and gas well. For use, fluid blasting tool (100) is configured in its closed position with the slidably positionable tubular outer sleeve (140) releasable attached to the tubular mandrel (110) by shear screws (112). Shear screws (112) are selected to shear at a predetermined pressure load placed in the production tubing (PT). The end of the wireline cable (WL) of a wireline unit is then attached at connection (120) of the fluid blasting tool (100) and the leading fluid bypass outlet (130) of the fluid blasting tool (100) is then inserted into a segment of obstructed production tubing (PT) of an oil and gas well.

When the fluid blasting tool (100) is inserted into the production tubing, the seals (160) around the outer periphery of the fluid blasting tool (100) will seal the annulus (A) between the fluid blasting tool (100) and production tubing (PT). This sealing will allow fluid pumped into the annulus (A) to create an increased fluid pressure at the trailing wireline connection (120) of the fluid blasting tool (100). Fluid (F) is then pumped down the production tubing (PT) above the fluid blasting tool (100). As fluid pressure increases, the fluid blasting tool (100) is pushed downward through the production tubing (PT) in advance of the trailing wireline cable (WL).

The fluid (F) introduced into the production tubing (PT) may be any suitable fluid or combination of fluids, though preferably fluid (F) will be a fluid or fluid combination that would help dissolve paraffin and scale obstructions in the production tubing (PT). A suitable fluid (F) will include heated fluid and chemicals that will enhance the dissolution of accumulated paraffin and scale to break up the obstruction and may include hot water, hot oil, and steam, surfactants including dispersants, soaps, cleaners, and degreasers, asphaltene solvents, xylene, and diesel fluid.

The resilient seals (160) are sufficiently flexible and resilient to allow the fluid blasting tool (100) to be inserted and removed by wireline cable (WL) through production tubing (PT), even tubing having geometry restrictions caused by factors such as S type nipples, X type nipples, gas lift mandrels, and changes in the size of the production tubing. The seals (160) may be made of resilient rubber, plastic, polyurethane, polypropylene or polyethylene materials or similar polymers and are selected to resist deterioration by the fluids (F) placed in the production tubing (PT). The seals (160) may also be provided with interior reinforcing (161) such as reinforcing screens, wires, or cables made of metal, such as stainless steel, or high strength polymer material, or similar reinforcing to aid in withstanding the stresses associated with compression and decompression as the seals (160) as the fluid blasting tool (100) is pushed and pulled through the production tubing (PT).

The fluid blasting tool (100) is pushed downward through the production tubing (PT) by the pressurized fluid (F) until an obstruction (O) is encountered in the (PT) as shown in FIG. 9B. With tubular sleeve (140) in the closed position on the tubular mandrel (110) of the fluid blasting tool (100), the pressure of the pressurized fluid (F) behind the fluid blasting tool (100) above the seals (160) causes fluid to enter the fluid perforations (147) that provide fluid passages for fluid into the annular fluid passage (148). Pressurized fluid then flows through fluid passage (148) to exit fluid to exit under pressure through fluid ejection ports (152) of nose cone (150) as a fluid blast for removing obstruction (O) in the tubing (PT).

The fluid ejection ports (152) may have one or more nozzles or jets (153) or may be configured as a nozzle or jet or a plurality of nozzles or jets to direct and concentrate the fluid blast from fluid ejection ports (152) to enhance the velocity of fluids injected for clearing obstructions. Providing and using heated fluids and chemicals for the pressurized fluid will also enhance the effectiveness of the blast of fluid (F) from fluid ejection ports (152) and the dissolution of obstructions (O) in the production tubing (PT).

To withdraw the fluid blasting tool (100) from the production tubing (PT) after the obstruction (O) is cleared or for subsequent operations on the production tubing or for other reasons, the pressure of the fluid (F) behind the blasting tool (100) and the seals (160) is increased to shear and separate the shear screws (112) holding the outer sleeve (140) in the closed position on tubular mandrel (110). The separation of the shear screws (112) by the increase in pressure will allow the outer sleeve (140) to shift and slide forward along the tubular mandrel (110) toward the fluid bypass outlet (130) in response to the fluid pressure behind the seals (160) to the open position as shown in FIGS. 3A and 3B and FIGS. 5 and 7.

When the outer sleeve (140) of the fluid blasting tool (100) moves to the open position, the fluid entry ports (146) are opened for unrestricted fluid communication with the central fluid passage (141) of the tubular mandrel (110). Fluid (F) in tubing (PT) above and to the rear of the fluid tool (100) and the seals (160) will then flow from fluid entry ports (146), downward through central fluid passage (141) of the tubular mandrel (110), to exit through fluid bypass outlet (130) and bypass annular fluid passage (148) and fluid ejection ports (152). The wireline tethered fluid blasting tool (100) may then be removed from the production tubing by the wireline reel without being unduly impeded by the fluid (F) in the tubing bore above the fluid blasting tool (100). The above-described fluid bypass reduces the risk of having the fluid blasting tool (100) becoming lodged or stuck in the production tubing during tool removal, reduces the risk of breaking the wireline cable (WL) or losing the connection between the wireline and the tool (100) with tool (100) still in the tubing (PT), and reduces the risk of inducing swabbing pressures in the wellbore tubing during tool removal.

Embodiment (200) of the fluid blasting tool is deployed, operated, and withdrawn for the (PT) in substantially the same manner as described for fluid blasting tool (100). In this embodiment seal (260) is assisted in its expansion by fluid pressure introduced into internal space (267) through fluid ports (269). The fins (265) serve as bumpers for protecting the polymer coating (266) from undue abrasion and for engaging the interior walls of the production tubing to contract cage (264) radially inward when narrowing tubing walls are encountered as the tool (200) moves along the wellbore tubing (PT).

The description of the fluid blasting tool (100) and the methods presented are intended to disclose to a person skilled in the art in which the invention pertains. Such a person will understand that various changes may be made in the form, construction and arrangement of the parts of the embodiments of the fluid blasting tool and the method of its use without departing from the spirit and scope of the invention or sacrificing its material advantages and embodiments of the invention described are merely examples of the invention.

We claim:

1. A wireline deployed fluid blasting tool comprising:

(a) a segment of production tubing;

(b) a wireline cable;

(c) a tubular mandrel having an upper end and a lower end, said upper end of said mandrel connected to said wireline cable and positioned in said segment of production tubing, said tubular mandrel having a central fluid passage in communication with upper fluid inlet ports, a fluid ejection outlet, and a plurality of lower fluid exit passages;

(d) a tubular outer sleeve releasably mounted around said tubular mandrel, said outer sleeve having an upper end and a plurality of fluid outlet ports, said releasably mounted outer sleeve restricting said upper fluid inlet ports of said tubular mandrel with said tubular mandrel restricting said fluid outlet ports of said releasably mounted outer sleeve;

(e) a resilient tubular seal fitted around said tubular outer sleeve, said seal sealing the annulus between said tubular outer sleeve and said segment of production tubing;

(f) pressurized fluid within said segment of production tubing above said fluid blasting tool whereby the pressure of said pressurized fluid will engage said, seal thereby moving said fluid blasting tool through said production tubing in advance of said wireline cable;

(g) said pressurized fluid flowing through said restricted upper fluid inlet ports and said central fluid passage of said tubular mandrel whereby said pressurized fluid is ejected from said tubular mandrel through said fluid ejection outlet; and (h) wherein said releasably mounted outer sleeve is released in response to fluid pressure whereby said outer is shifted to open said upper fluid inlet ports of said tubular mandrel and align said lower fluid exit passages of said outer sleeve with said fluid outlet ports of said mandrel thereby allowing said pressurized fluid to flow through said central fluid passage of said tubular mandrel to exit said lower fluid exit passages when said tubular mandrel and said outer sleeve are pulled from said tubing by said wireline cable.

2. The wireline deployed fluid blasting tool recited in claim 1 wherein said pressurized fluid is heated.

3. The wireline deployed fluid blasting tool recited in claim 1 wherein said pressurized fluid is a paraffin dissolving fluid.

4. The wireline deployed fluid blasting tool recited in claim 1 wherein said tubular outer sleeve is releasably mounted around said tubular mandrel by means of shear screws.

5. The wireline deployed fluid blasting tool recited in claim 4 wherein said resilient tubular seal is tapered at each end.

6. A method for clearing tubing comprising the steps of:

(a) providing a segment of tubing;

(b) providing a wireline cable;

(c) providing a tubular mandrel having an upper end and a lower end, said tubular mandrel having a central fluid passage in communication with upper fluid inlet ports, a fluid ejection outlet, and a plurality of lower fluid exit passages;

(d) providing an outer, sleeve having an upper end and a plurality of lower fluid outlet ports;

(e) releasably mounting said tubular outer sleeve around said tubular mandrel thereby restricting said upper fluid inlet ports of said tubular mandrel with said tubular outer sleeve and restricting said fluid outlet ports of said tubular outer sleeve with said tubular mandrel;

(f) providing a resilient tubular seal around said tubular outer sleeve;

(g) attaching said upper end of said tubular mandrel to said wireline cable;

(h) inserting said lower end of said tubular mandrel into said segment of tubing thereby sealing the annulus between said tubular outer sleeve and said segment with said resilient tubular seal;

(i) injecting pressurized fluid within said segment of tubing thereby moving said tubular mandrel and tubular outer sleeve through said tubing in advance of said wireline cable, said pressurized fluid flowing through said restricted upper fluid inlet ports and said central fluid passage of said tubular mandrel; and (j) ejecting said pressurized fluid from said tubular mandrel through said fluid ejection outlet.

7. The method for clearing tubing recited in claim 6 comprising the additional steps of:

(a) increasing the pressure of said pressurized fluid thereby releasing said tubular outer sleeve from said tubular mandrel;

(b) sliding said tubular outer sleeve toward said lower end of said tubular mandrel thereby opening said upper fluid inlet ports of said tubular mandrel; and (c) pulling said tubular mandrel and said outer sleeve from said tubing by said wireline cable whereby said pressurized fluid flows through said central fluid passage and said lower fluid exit passages of said tubular mandrel.

8. The method for clearing tubing, recited in claim 7 wherein said pressurized fluid includes paraffin dissolving chemicals.

9. The method for clearing tubing recited in claim 7 comprising the additional step of heating said pressurized fluid prior to injecting pressurized fluid within said segment of tubing.

10. The method for clearing tubing recited claim 7 further comprising the additional steps of:

(a) providing a quantity of shear screws; and (b) releasably mounting said tubular mandrel with said shear screws.

11. The wireline deployed fluid blasting tool recited in claim 10 wherein said resilient tubular seal is tapered at each end.

12. The method for clearing tubing recited in claim 11 comprising the additional step of injecting heated pressurized fluid within said segment of tubing.

13. The method for clearing tubing recited in claim 6 comprising the additional step of heating said pressurized fluid prior to injecting pressurized fluid within said segment of tubing.

14. The method for clearing tubing recited in claim 6 wherein said pressurized fluid includes paraffin dissolving chemicals.

15. A fluid blasting tool comprising:

(a) a tubular mandrel having an upper end and a lower end, said upper end of said tubular mandrel having a threaded connection end, a central fluid passage in communication with at least one upper fluid inlet port, a fluid ejection outlet, and at least one lower fluid exit passage, wherein said threaded connection end of said tubular mandrel is attached to a wireline;

(b) a tubular outer sleeve having at least one lower fluid outlet port;

(c) At least one shear screw releasably attaching said tubular outer sleeve to said tubular mandrel whereby said tubular outer sleeve restricts fluid flow to said at least one upper fluid inlet port of said tubular mandrel and said tubular mandrel restricts fluid flow through said at least one lower fluid exit passage; and (d) a resilient tubular seal fitted around said tubular outer sleeve.

16. The fluid blasting tool recited in claim 15 wherein said fluid blasting tool is inserted into well tubing of an oil and gas well.

17. The fluid blasting tool recited in claim 16 wherein:

(a) the annulus between said tubular outer sleeve and said tubing is sealed by said tubular seal whereby said fluid blasting tool may be advanced through said production tubing in response to fluid pressure; and (b) wherein pressurized fluid is ejected from said fluid ejection outlet of said tubular mandrel in response to said fluid pressure.

18. The fluid blasting, tool recited in claim 17 wherein said least one shear screw severs to release and shift said tubular outer sleeve in response to fluid pressure whereby said tubular outer sleeve slides on said tubular mandrel opening said at least one upper fluid inlet port and aligning said at least one lower fluid outlet port of said tubular outer sleeve with said at least one lower fluid exit passage of said tubular mandrel.

19. The fluid blasting tool recited in claim 18 wherein, said resilient tubular seal is an elongated seal having elongated tapered ends.

20. The fluid blasting tool recited in claim 18 further comprising radially extending shoulders adjacent said resilient tubular seal.

21. The fluid blasting tool recited in claim 18 wherein:

(a) said at least one lower fluid outlet port in said tubular outer sleeve includes a plurality of radially extending fluid outlet ports;

(b) said at least one upper fluid inlet port in said tubular mandrel includes a plurality of radially extending upper fluid inlet ports; and (c) said at least one lower fluid exit passage in said tubular mandrel includes a plurality of radially extending lower fluid exit passages.

22. The fluid blasting tool recited in claim 21 wherein said fluid pressure is generated by a pressurized fluids selected from the group comprising hot water, hot oil, steam, surfactants, asphaltene solvents, xylene, and diesel fluid.

23. The fluid blasting tool recited in claim 22 wherein said tubing of an oil and gas well is production tubing.

24. The fluid blasting tool recited in claim 23 wherein said resilient tubular seal is an elongated tubular seal tapered at each end.

25. The fluid blasting tool recited in claim 24 wherein said tapered ends of said elongated seal are no more than 30 degrees from the horizontal.

26. The fluid blasting tool recited in claim 25 wherein said elongated seal has a fluid port in fluid communication with an internal fluid chamber whereby fluid may be entered into said chamber.

* * * * *